US010072899B2

(12) United States Patent
Gao et al.

(10) Patent No.: US 10,072,899 B2
(45) Date of Patent: Sep. 11, 2018

(54) SPIRAL LOUVER SHAPED CONDENSER WITH MULTILAYER SPATIAL STRUCTURE

(71) Applicant: HENAN NEW KELONG ELECTRICAL APPLIANCES CO., LTD, Xinxiang, Henan (CN)

(72) Inventors: Xiangqi Gao, Xinxiang (CN); Jinfa Zhang, Xinxiang (CN); Baojia Kang, Xinxiang (CN); Qingfeng Cheng, Xinxiang (CN); Zhouzheng Han, Xinxiang (CN); Song Zhang, Xinxiang (CN); Chengbing Shen, Xinxiang (CN); Jianxin Chai, Xinxiang (CN); Kai Liang, Xinxiang (CN)

(73) Assignee: Henan New Kelong Electrical Appliances, Co., Ltd., Henan (CN)

( * ) Notice: Subject to any disclaimer, the term of this patent is extended or adjusted under 35 U.S.C. 154(b) by 2 days.

(21) Appl. No.: 15/311,222

(22) PCT Filed: May 15, 2015

(86) PCT No.: PCT/CN2015/079031
§ 371 (c)(1),
(2) Date: Nov. 15, 2016

(87) PCT Pub. No.: WO2015/172738
PCT Pub. Date: Nov. 19, 2015

(65) Prior Publication Data

US 2017/0074600 A1 Mar. 16, 2017

(30) Foreign Application Priority Data

May 16, 2014 (CN) ..... 2014 1 0208312
Jul. 21, 2014 (CN) ..... 2014 1 0352873

(51) Int. Cl.
*F28F 1/14* (2006.01)
*F28F 1/36* (2006.01)
(Continued)

(52) U.S. Cl.
CPC ..... *F28F 1/36* (2013.01); *F25B 39/00* (2013.01); *F25B 39/04* (2013.01); *F28F 21/082* (2013.01);
(Continued)

(58) Field of Classification Search
CPC .. F28F 9/0137; F28F 3/027; F28F 3/08; F28F 1/36
(Continued)

(56) References Cited

U.S. PATENT DOCUMENTS 2,667,337 A * 1/1954 Chapman ..... F28F 1/36 165/184
3,519,070 A * 7/1970 Bappler ..... F28F 1/36 165/133
(Continued)

FOREIGN PATENT DOCUMENTS

CN 2254176 5/1997
CN 2292269 9/1998
(Continued)

OTHER PUBLICATIONS

International Search Report filed in PCT/CN2015/079031dated Aug. 14, 2015.

*Primary Examiner* — David Teitelbaum
*Assistant Examiner* — Paul Alvare
(74) *Attorney, Agent, or Firm* — Rankin, Hill & Clark LLP

(57) ABSTRACT

A spiral louver shaped condenser includes fins and a refrigeration pipe. The fins are spirally wound about the refrigeration pipe and integrally formed by stamping a strip-
(Continued)

shaped sheet material, at least including first heat-absorbing and heat-radiating bodies and second heat-absorbing and heat-radiating bodies. Broken lines are arranged between adjacent heat-absorbing and heat-radiating bodies, and each heat-absorbing and heat-radiating body forms a wavy structure. Relative wave crests and wave troughs are formed at each broken line between the adjacent heat-absorbing and heat-radiating bodies, wherein the crests and troughs form a honeycomb structure together. The wavy edges of the first heat-absorbing and heat-radiating bodies make contact with the outer wall of the refrigeration pipe at equal screw pitches.

18 Claims, 4 Drawing Sheets

(51) Int. Cl.

| | |
|---|---|
| ***F28F 13/12*** | (2006.01) |
| ***F28D 7/12*** | (2006.01) |
| ***F25B 39/00*** | (2006.01) |
| ***F25B 39/04*** | (2006.01) |
| ***F28F 21/08*** | (2006.01) |
| *F28F 9/013* | (2006.01) |
| *F28F 3/02* | (2006.01) |

(52) U.S. Cl.
CPC ..... *F28F 21/084* (2013.01); *F28F 21/085* (2013.01); *F28F 3/027* (2013.01); *F28F 9/0137* (2013.01); *F28F 2215/04* (2013.01); *F28F 2215/08* (2013.01)

(58) Field of Classification Search
USPC ..... 165/109.1, 156, 184
See application file for complete search history.

(56) References Cited

U.S. PATENT DOCUMENTS

| | | | | |
|---|---|---|---|---|
| 3,789,786 | A * | 2/1974 | Wiedenmann | B21C 37/225 29/456 |
| 4,336,642 | A * | 6/1982 | Engelberts | B21C 37/22 165/157 |
| 5,033,544 | A * | 7/1991 | Abbott | B21C 37/26 165/181 |
| 6,901,995 | B2 | 6/2005 | Yamaguchi et al. | |
| 7,418,848 | B2 * | 9/2008 | Im | B21C 37/207 72/370.16 |

FOREIGN PATENT DOCUMENTS

| | | | | |
|---|---|---|---|---|
| CN | 102853705 | | 1/2013 | |
| CN | 104132485 | | 11/2014 | |
| CN | 203980727 | | 12/2014 | |
| EP | 0091127 | A1 * | 10/1983 | F28F 1/36 |

* cited by examiner

SPIRAL LOUVER SHAPED CONDENSER WITH MULTILAYER SPATIAL STRUCTURE

TECHNICAL FIELD

The present invention relates to refrigeration and heat radiating device, particularly relates to a spiral louver shaped condenser with a multilayer spatial structure.

BACKGROUND

Current luxurious air-cooling frostless and micro-frost refrigerators of double doors, three doors and multiple doors, etc. are increasingly occupying a leading status of a refrigerator market. With the increase of the refrigerator volume and the refrigeration requirement, requirements for heat exchange power and heat exchange efficiency of a radiator or condenser in a refrigeration process are higher. An ordinary steel plate twined spiral plate tube type condenser or a fiber tube type condenser with a steel wire and steel pipe welding structure cannot satisfy the demand of industry development of refrigerators and radiators. A condenser or radiator with smaller volume and higher heat dissipation efficiency is needed to appear.

A patent with the Chinese patent application number 201210255460.X, the application date of Jul. 23, 2012, application publication date of Jan. 2, 2013 and the application publication number CN102853705A, discloses "a spiral fin type heat exchange tube". A spiral fin type heat exchange tube comprises an aluminum tube with a passage in the middle, and spiral fins are spirally wrapped outside the aluminum tube. The spiral fin type heat exchange tube is characterized in that each spiral fin is of a banded structure; one side edge of the spiral fin is a straight edge; the other side edge of the spiral fin is a wavy edge; and the straight edge sticks close to the outer surface of the aluminum tube. The spiral fins are spirally wrapped at equal intervals along the axis of the aluminum tube. The present invention has the following beneficial effects: one side edge of the spiral fin is a straight edge, and the other side edge of the spiral fin is a wavy edge; the straight edge sticks close to the outer part of the aluminum tube; the wavy edge is at the outer part, thereby expanding the heat radiating area of the spiral fin and enhancing the heat radiating effect of the heat exchanger tube; and the spiral fin has a band shape without forming a closed inner cavity, thereby ensuring that both side surfaces of the spiral fin contact the outside.

In the above patent application, because the lower straight edge part sticks close to the aluminum tube, the contact area of the lower straight edge and the aluminum tube is small and the heat radiating effect is poor. Although the upper part is made into the wavy edge, after the spiral fin is spirally wrapped on the aluminum tube, the fins of the upper part which is away from the aluminum tube have poor circulation of dense air, so heat exchange effectiveness is greatly reduced. The technical problem to be urgently solved in the industry is to not only increase the contact area and the heat radiating area of the spiral fins and the aluminum tube, but also ensure good air circulation.

SUMMARY

The technical problem to be solved by the present invention is to provide a spiral louver shaped condenser with a multilayer spatial structure. Fins of the spiral louver shaped condenser are of a multilayer honeycomb structure, thereby increasing the heat radiating area. The fins are cut off discontinuously, causing that a part of fins far away from a refrigerating pipeline have lower temperature and a larger temperature difference, thereby accelerating air flow. The fins with a multilayer honeycomb structure have more ventilation passages, change an airflow field, further convert a laminar flow into a turbulent flow, and accelerate a heat radiating effect. Seen from the test data, the heat radiating effect of the present invention is greatly higher than those of an ordinary fiber tube type and a spiral plate tube type condenser product, and the present invention enhances the condensation effect of a large-scale air-cooled refrigerator condenser.

To solve the above technical problem, the following technical solution is adopted in the present invention: a spiral louver shaped condenser with a multilayer spatial structure comprises fins and a refrigerating tube around which the fins are spirally wrapped at a constant pitch on the outer wall. The fins are integrally formed by stamping strip-shaped sheets; the fins comprise at least first heat-absorbing and heat-radiating bodies and second heat-absorbing and heat-radiating bodies; broken lines are arranged between adjacent heat-absorbing and heat-radiating bodies; each heat-absorbing and heat-radiating body forms a wave structure so as to increase the heat absorption and heat radiating area of the fins and the refrigerating tube; a relative wave crest and a relative wave trough are formed at each broken line between adjacent heat-absorbing and heat-radiating bodies; the wave crests and wave troughs formed at all the broken lines between adjacent heat-absorbing and heat-radiating bodies form a honeycomb structure together; the multilayer strip-shaped fins are cut off discontinuously and the wave structure is formed by multiple layers, causing that a part of fins in contact with the refrigerating tube have high temperature and a part of adjacent fins far away from the refrigerating tube have lower temperature; and two parts of fins have a large temperature difference, thereby accelerating the air flow. The fins with a multilayer honeycomb structure have more ventilation passages, change an airflow field, further convert a laminar flow into a turbulent flow, and accelerate a heat radiating effect. The wavy edge of the first heat-absorbing and heat-radiating body makes contact with the outer wall of the refrigerating tube in a spiral wrapping manner at a constant pitch. The contact between the wavy edge and the refrigerating tube increases the contact area between the fins and the refrigerating tube relative to the prior art. A perpendicular distance from a wave crest level of the second heat-absorbing and heat-radiating body to a wave trough level of the first heat-absorbing and heat-radiating body is greater than a perpendicular distance from a wave crest level of the first heat-absorbing and heat-radiating body to a wave trough level of the first heat-absorbing and heat-radiating body, in order to form a staggered honeycomb structure. Because the staggering peak honeycomb structure is perpendicular to the outer wall of the refrigerating tube, after hot air rises along a wave trough direction from one wave trough of the first heat-absorbing and heat-radiating body, the hot air continues to rise along the wave crest, corresponding to the wave trough, of the second heat-absorbing and heat-radiating body; and in the rise process, the hot air performs heat exchange with the first heat-absorbing and heat-radiating body and the second heat-absorbing and heat-radiating body respectively, thereby enhancing heat-exchange rate.

The perpendicular distance from the wave crest level of the second heat-absorbing and heat-radiating body to the wave trough level of the first heat-absorbing and heat-radiating body is 0.5 to 3 times of the perpendicular distance from the wave crest level of the first heat-absorbing and heat-radiating body to the wave trough level of the first heat-absorbing and heat-radiating body, so as to increase the possibility that the second heat-absorbing and heat-radiating body contacts the hot air which rises on the surface of the refrigerating tube to absorb heat.

The width of the fins is 3 mm to 20 mm and the thickness of the fins is 0.1 mm to 0.5 mm.

The pitch of the fins on the refrigerating tube is 3 mm to 20 mm.

The tube diameter of the refrigerating tube is 4 mm to 10 mm and the thickness of the tube wall of the refrigerating tube is 0.4 mm to 1 mm.

The refrigerating tube is a copper tube and the fins are a copper sheet, or the refrigerating tube is a steel tube and the fins are a steel sheet, or the refrigerating tube is an aluminum tube and the fins are an aluminum sheet, or the refrigerating tube is a copper tube and the fins are an aluminum sheet, or the refrigerating tube is a steel tube and the fins are an aluminum sheet.

The present invention has the following beneficial effects:

The present invention is a spiral louver shaped condenser with a multilayer spatial structure. Because the louver shaped fin is a multilayer honeycomb structure, the heat radiating area is increased. The fins are cut off discontinuously, causing that a part of fins far away from a refrigerating pipeline have lower temperature and a larger temperature difference, thereby accelerating air flow. The fins with the multilayer honeycomb structure have more ventilation passages, change an airflow field, further convert a laminar flow into a turbulent flow, and accelerate a heat radiating effect. Seen from the test data, the heat radiating effect of the present invention is greatly higher than those of an ordinary fiber tube type and a spiral plate tube type condenser product, and the present invention enhances the condensation effect of a large-scale air-cooled refrigerator condenser.

BRIEF DESCRIPTION OF DRAWINGS

The specific embodiments of the present invention will be further described below in detail in conjunction with the accompanying drawings.

DETAILED DESCRIPTION

Figure 1:
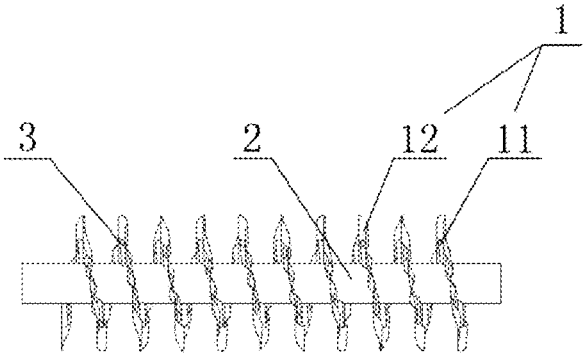
FIG. 1 shows a schematic diagram of an integral structure of the present invention.
Figure 2:
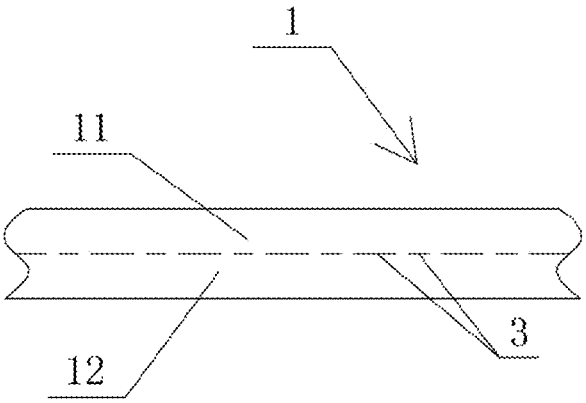
FIG. 2 shows a structural schematic diagram of a sheet before fins are stamped in embodiment 1 of the present invention.
Figure 3:
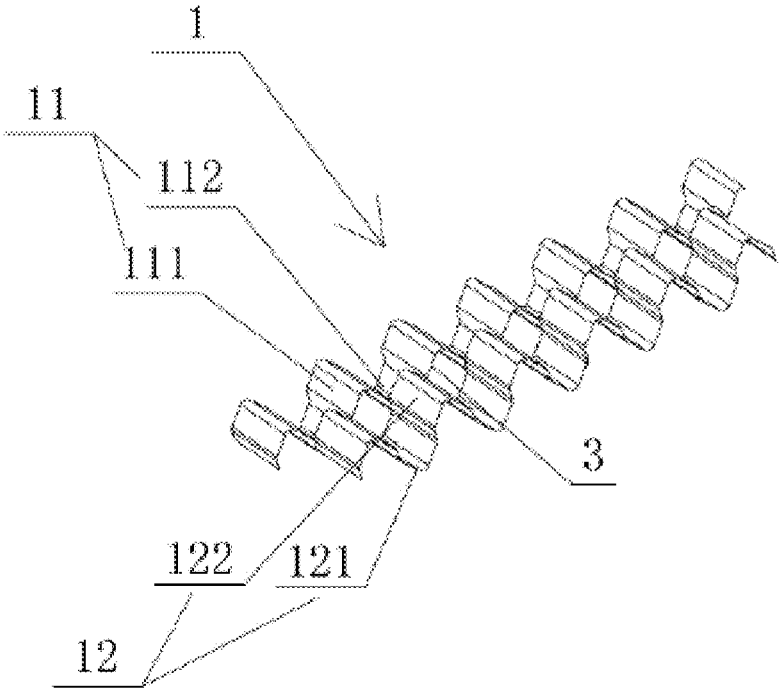
FIG. 3 shows a stereographic structural schematic diagram of fins in embodiment 1 of the present invention.
Figure 4:
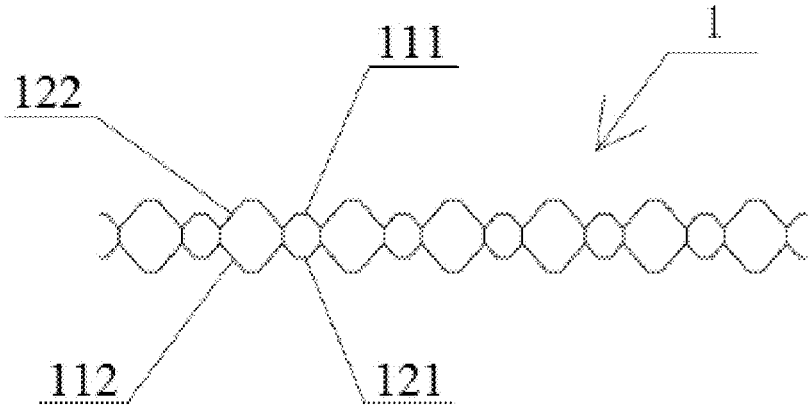
FIG. 4 shows a sectional structural schematic diagram of fins in embodiment 1 of the present invention.

To describe the present invention more clearly, the present invention is further described below in combination with the preferred embodiments and the drawings. Those skilled in the art should understand that the contents which are specifically described below are illustrative, rather than restrictive, and shall not be regarded as limiting the protection scope of the present invention.

Embodiment 1

With reference to FIG. 1 to FIG. 4, a spiral louver shaped condenser with a multilayer spatial structure comprises fins 1 and a refrigerating tube 2 around which the fins 1 are spirally wrapped at a constant pitch on the outer wall. The fins 1 are integrally formed by stamping strip-shaped sheets; the fins 1 comprise at least first heat-absorbing and heat-radiating body 11 and second heat-absorbing and heat-radiating body 12; broken lines 3 are arranged between adjacent heat-absorbing and heat-radiating bodies bodies 11, 12; each heat-absorbing and heat-radiating body forms a wave structure; a relative wave crest 111 and a wave trough 121 are formed at each broken line 3 between adjacent heat-absorbing and heat-radiating bodies 11, 12; the wave crests and wave troughs formed at all the broken line 3 between adjacent heat-absorbing and heat-radiating bodies 11, 12 form a honeycomb structure together; the wavy edge of the first heat-absorbing and heat-radiating body 11 contacts the outer wall of the refrigerating tube 2 in a spiral wrapping manner at a constant pitch; and a perpendicular distance from a wave crest 122 level of the second heat-absorbing and heat-radiating body 12 to a wave trough 112 level of the first heat-absorbing and heat-radiating body 11 is greater than a perpendicular distance from a wave crest 111 level of the first heat-absorbing and heat-radiating body 11 to a wave trough 112 level of the first heat-absorbing and heat-radiating body 11.

The perpendicular distance from the wave crest 122 level of the second heat-absorbing and heat-radiating body 12 to the wave trough 112 level of the first heat-absorbing and heat-radiating body 11 is 1.5 times of the perpendicular distance from the wave crest 111 level of the first heat-absorbing and heat-radiating body 11 to the wave trough 112 level of the first heat-absorbing and heat-radiating body 11.

The width of the fins 1 is 6 mm and the thickness of the fins 1 is 0.3 mm.

The pitch of the fins 1 on the refrigerating tube 2 is 6 mm.

The tube diameter of the refrigerating tube 2 is 7 mm and the thickness of the tube wall of the refrigerating tube 2 is 0.7 mm.

The refrigerating tube 2 is a steel tube and the fins 1 are an aluminum sheet.

Embodiment 2

Figure 5:
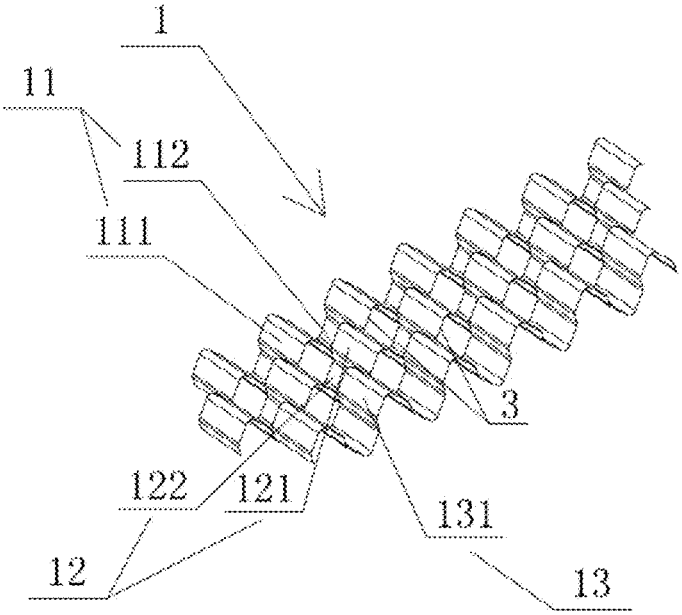
FIG. 5 shows a stereographic structural schematic diagram of fins in another embodiment of the present invention.
Figure 6:
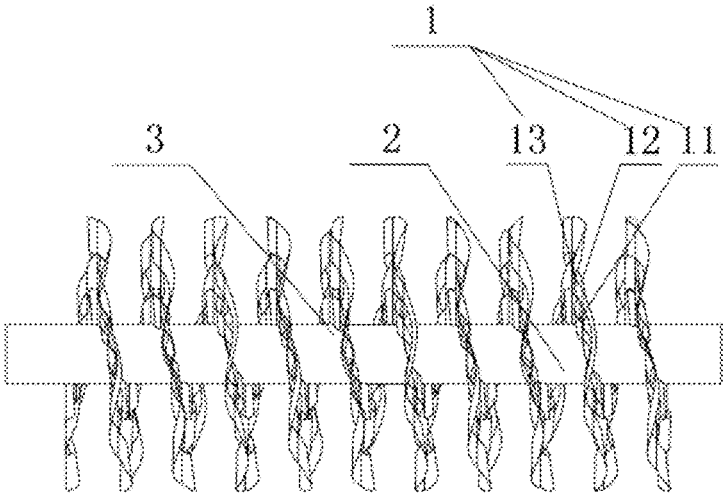
FIG. 6 shows a schematic diagram of an integral structure of another embodiment of the present invention.

With reference to FIG. 5 to FIG. 6 which show a spiral louver shaped condenser with a multilayer spatial structure. The difference between embodiment 2 and embodiment 1 is that the fins 1 comprise a first heat-absorbing and heat-radiating body 11, a second heat-absorbing and heat-radiating body 12 and a third heat-absorbing and heat-radiating body 13; the wavy edge of the first heat-absorbing and heat-radiating body 11 contacts the outer wall of the refrigerating tube 2 in a spiral wrapping manner at a constant pitch; a perpendicular distance from a wave crest 131 level of the third heat-absorbing and heat-radiating body 13 to a wave trough 121 level of the second heat-absorbing and heat-radiating body 12 is greater than a perpendicular distance from a wave crest 122 level of the second heat-absorbing and heat-radiating body 12 to a wave trough 121 level of the second heat-absorbing and heat-radiating body 12; and a perpendicular distance from a wave crest 122 level of the second heat-absorbing and heat-radiating body 12 to a wave trough 112 level of the first heat-absorbing and heat-radiating body 11 is greater than a perpendicular distance from a wave crest 111 level of the first heat-absorbing and heat-radiating body 11 to a wave trough 112 level of the first heat-absorbing and heat-radiating body 11.

A perpendicular distance from a wave crest 131 level of the third heat-absorbing and heat-radiating body 13 to a wave trough 121 level of the second heat-absorbing and heat-radiating body 12 is 1.5 times of a perpendicular distance from a wave crest 122 level of the second heat-absorbing and heat-radiating body 12 to a wave trough 121 level of the second heat-absorbing and heat-radiating body 12; and a perpendicular distance from a wave crest 122 level of the second heat-absorbing and heat-radiating body 12 to a wave trough 112 level of the first heat-absorbing and heat-radiating body 11 is 2 times of a perpendicular distance from a wave crest 111 level of the first heat-absorbing and heat-radiating body 11 to a wave trough 112 level of the first heat-absorbing and heat-radiating body 11.

The width of the fins 1 is 8 mm and the thickness of the fins 1 is 0.4 mm.

The pitch of the fins 1 on the refrigerating tube 2 is 8 mm.

The tube diameter of the refrigerating tube 2 is 8 mm and the thickness of the tube wall of the refrigerating tube 2 is 0.8 mm.

The refrigerating tube 2 is a copper tube and the fins 1 are an aluminum sheet.

REFERENCE EXAMPLE 1

Embodiment 1 of a Chinese patent application number 201210255460.X is used as a reference example 1.

REFERENCE EXAMPLE 2

The refrigerating tube is bent at the same level into a serpentuator. At the same side as the vertical direction of a serpentuator pipeline, multiple metal wires are welded at equal distances. The serpentuator welded with the metal wires is bent into a square cylindrical body to form a fiber tube coiled condenser, as a reference example 2.

Experiment Results and Analysis

Test Conditions

No. 1 heat exchanger is a heat exchanger of the present embodiment 1; No. 2 heat exchanger is a heat exchanger of the present reference example 1; and No. 3 heat exchanger is a heat exchanger of the present reference example 2. Three heat exchangers have the same pipeline length and state.

Through configuration test software, ambient temperature is kept at 25° C.±0.5° C.; the temperature of a water tank is below 73° C.; and by using water as a medium, the performance of three heat exchangers is tested. Under the condition that the temperature of the water tank reaches up to 73° C., the inlet temperature of No. 1 to No. 3 heat exchangers is 61° C.±0.8° C.; inlet and outlet temperature of the heat exchanger of a system test bed is respectively measured after three different heat exchanger products are installed; the experiment data are detected and recorded; and the experiment results are contrasted, calculated and analyzed.

Figure 7:
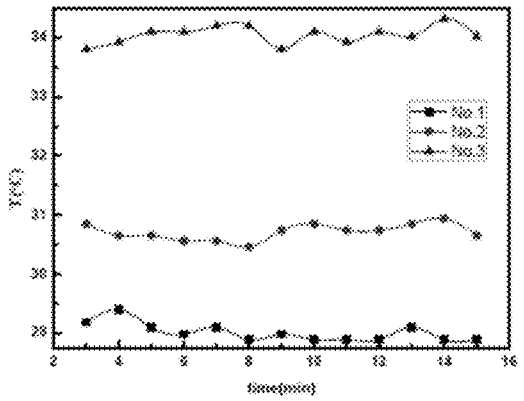
FIG. 7 shows a contrast change chart of outlet temperature for embodiment 1, reference example 1 and reference example 2 of the present invention.
Figure 8:
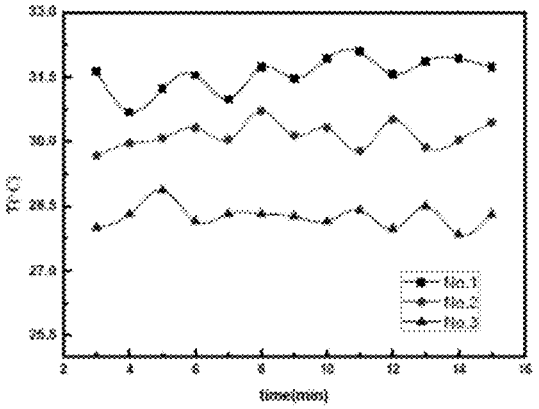
FIG. 8 shows a contrast change chart of a temperature difference between an inlet and an outlet for embodiment 1, reference example 1 and reference example 2 of the present invention.

The experiment results of No. 1 heat exchanger, No. 2 heat exchanger and No. 3 heat exchanger are as follows:

With reference to FIG. 7 to FIG. 8, it can be known from the contrast chart of outlet temperature that from No. 1 heat exchanger, No. 2 heat exchanger and No. 3 heat exchanger the outlet temperature of the heat exchangers is from low to high. The higher the outlet temperature is, the smaller the temperature difference is, and the smaller the heat transfer amount is, the poorer the heat exchange effect is. It is known from the contrast chart of the temperature difference between an inlet and an outlet that No. 1 heat exchanger has the maximum heat exchange temperature difference between the inlet and the outlet, the second is No. 2 heat exchanger and the third is No. 3 heat exchanger. Therefore, No. 1 heat exchanger, i.e., the spiral louver shaped condenser with a multilayer spatial structure of the present invention, has the best heat exchange effect; the second is No. 2-ordinary coiled spiral fin condenser; and the third is No. 3-fiber tube coiled condenser.

It is apparent that the above embodiments of the present invention are merely examples given for clearly illustrating the present invention, not for limiting the embodiments of the present invention. For those ordinary skilled in the art, different forms of other variations or changes can also be made based on the above description. The embodiments are not exhaustive herein. Apparent variations or changes derived from the technical solution of the present invention still belong to the protection scope of the present invention.

The invention claimed is:

1. A spiral louver shaped condenser with a multilayer spatial structure, comprising fins and a refrigerating tube around which the fins are spirally wrapped at a constant pitch on an outer wall of the refrigerating tube, wherein the fins are integrally formed by stamping strip-shaped sheets; the fins comprise multiple heat absorbing and heat-radiating bodies, including at least a first heat-absorbing and heat-radiating body and a second heat-absorbing and heat-radiating body; each heat-absorbing and heat-radiating body forms a wave structure; a relative wave crest and a relative wave trough are formed between the adjacent heat-absorbing and heat-radiating bodies; the wave crests and wave troughs formed between adjacent heat-absorbing and heat-radiating bodies form a honeycomb structure together; a wavy edge of the first heat-absorbing and heat-radiating body makes contact with the outer wall of the refrigerating tube in a spiral wrapping manner at a constant pitch; and a perpendicular distance from a wave crest level of the second heat-absorbing and heat-radiating body to a wave trough level of the first heat-absorbing and heat-radiating body is greater than a perpendicular distance from a wave crest level of the first heat-absorbing and heat-radiating body to a wave trough level of the first heat-absorbing and heat-radiating body.

2. The spiral louver shaped condenser with a multilayer spatial structure according to claim 1, wherein:

the perpendicular distance from the wave crest level of the second heat-absorbing and heat-radiating body to the wave trough level of the first heat-absorbing and heat-radiating body is up to 3 times of the perpendicular distance from the wave crest level of the first heat-absorbing and heat-radiating body to the wave trough level of the first heat-absorbing and heat-radiating body.

3. The spiral louver shaped condenser with a multilayer spatial structure according to claim 1, wherein:

the width of the fins is 3 mm to 20 mm.

4. The spiral louver shaped condenser with a multilayer spatial structure according to claim 1, wherein:

the thickness of the fins is 0.1 mm to 0.5 mm.

5. The spiral louver shaped condenser with a multilayer spatial structure according to claim 1, wherein:

the pitch of the fins on the refrigerating tube is 3 mm to 20 mm.

6. The spiral louver shaped condenser with a multilayer spatial structure according to claim 1, wherein: the tube diameter of the refrigerating tube is 4 mm to 10 mm.

7. The spiral louver shaped condenser with a multilayer spatial structure according to claim 1, wherein:

the thickness of the tube wall of the refrigerating tube is 0.4 mm to 1 mm.

8. The spiral louver shaped condenser with a multilayer spatial structure according to claim 1, wherein:

the refrigerating tube is a copper tube and the fins are a copper sheet, or the refrigerating tube is a steel tube and the fins are a steel sheet, or the refrigerating tube is an aluminum tube and the fins are an aluminum sheet, or the refrigerating tube is a copper tube and the fins are an aluminum sheet, or the refrigerating tube is a steel tube and the fins are an aluminum sheet.

9. The spiral louver shaped condenser with a multilayer spatial structure according to claim 2, wherein:

the refrigerating tube is a copper tube and the fins are a copper sheet, or the refrigerating tube is a steel tube and the fins are a steel sheet, or the refrigerating tube is an aluminum tube and the fins are an aluminum sheet, or the refrigerating tube is a copper tube and the fins are an aluminum sheet, or the refrigerating tube is a steel tube and the fins are an aluminum sheet.

10. The spiral louver shaped condenser with a multilayer spatial structure according to claim 3, wherein:

the refrigerating tube is a copper tube and the fins are a copper sheet, or the refrigerating tube is a steel tube and the fins are a steel sheet, or the refrigerating tube is an aluminum tube and the fins are an aluminum sheet, or the refrigerating tube is a copper tube and the fins are an aluminum sheet, or the refrigerating tube is a steel tube and the fins are an aluminum sheet.

11. The spiral louver shaped condenser with a multilayer spatial structure according to claim 4, wherein:

the refrigerating tube is a copper tube and the fins are a copper sheet, or the refrigerating tube is a steel tube and the fins are a steel sheet, or the refrigerating tube is an aluminum tube and the fins are an aluminum sheet, or the refrigerating tube is a copper tube and the fins are an aluminum sheet, or the refrigerating tube is a steel tube and the fins are an aluminum sheet.

12. The spiral louver shaped condenser with a multilayer spatial structure according to claim 5, wherein:

the refrigerating tube is a copper tube and the fins are a copper sheet, or the refrigerating tube is a steel tube and the fins are a steel sheet, or the refrigerating tube is an aluminum tube and the fins are an aluminum sheet, or the refrigerating tube is a copper tube and the fins are an aluminum sheet, or the refrigerating tube is a steel tube and the fins are an aluminum sheet.

13. The spiral louver shaped condenser with a multilayer spatial structure according to claim 6, wherein:

the refrigerating tube is a copper tube and the fins are a copper sheet, or the refrigerating tube is a steel tube and the fins are a steel sheet, or the refrigerating tube is an aluminum tube and the fins are an aluminum sheet, or the refrigerating tube is a copper tube and the fins are an aluminum sheet, or the refrigerating tube is a steel tube and the fins are an aluminum sheet.

14. The spiral louver shaped condenser with a multilayer spatial structure according to claim 7, wherein:

the refrigerating tube is a copper tube and the fins are a copper sheet, or the refrigerating tube is a steel tube and the fins are a steel sheet, or the refrigerating tube is an aluminum tube and the fins are an aluminum sheet, or the refrigerating tube is a copper tube and the fins are an aluminum sheet, or the refrigerating tube is a steel tube and the fins are an aluminum sheet.

15. The spiral louver shaped condenser with a multilayer spatial structure according to claim 1, the fins further comprising:

at least a third heat-absorbing and heat-radiating body.

16. The spiral louver shaped condenser with a multilayer spatial structure according to claim 15, wherein:

a perpendicular distance from a wave crest level of the third heat-absorbing and heat-radiating body to a wave trough level of the second heat-absorbing and heat-radiating body is greater than a perpendicular distance from a wave crest level of the second heat-absorbing and heat-radiating body to a wave trough level of the second heat-absorbing and heat-radiating body.

17. The spiral louver shaped condenser with a multilayer spatial structure according to claim 15, wherein:

the perpendicular distance from a wave crest level of the third heat-absorbing and heat-radiating body to a wave trough level of the second heat-absorbing and heat-radiating body is at most 1.5 times of the perpendicular distance from a wave crest level of the second heat-absorbing and heat-radiating body to a wave trough level of the second heat-absorbing and heat-radiating body.

18. The spiral louver shaped condenser with a multilayer spatial structure according to any of claim 15, wherein:

the refrigerating tube is a copper tube and the fins are a copper sheet, or the refrigerating tube is a steel tube and the fins are a steel sheet, or the refrigerating tube is an aluminum tube and the fins are an aluminum sheet, or the refrigerating tube is a copper tube and the fins are an aluminum sheet, or the refrigerating tube is a steel tube and the fins are an aluminum sheet.

* * * * *